US006715152B2

(12) United States Patent
Mazzarolo

(10) Patent No.: US 6,715,152 B2
(45) Date of Patent: Apr. 6, 2004

(54) MOTORCYCLING GLOVE

(75) Inventor: Giovanni Mazzarolo, Coste di Maser (IT)

(73) Assignee: Alpinestars SpA, Asolo (IT)

( * ) Notice: Subject to any disclaimer, the term of this patent is extended or adjusted under 35 U.S.C. 154(b) by 0 days.

(21) Appl. No.: 10/243,640

(22) Filed: Sep. 12, 2002

(65) Prior Publication Data

US 2003/0066119 A1 Apr. 10, 2003

Related U.S. Application Data

(63) Continuation of application No. PCT/EP01/02936, filed on Mar. 15, 2001.

(30) Foreign Application Priority Data

Mar. 17, 2000 (IT) ..... MI2000A0565

(51) Int. Cl.[7] ..... A41D 19/00
(52) U.S. Cl. ..... 2/161.6; 2/21; 2/160; 2/163
(58) Field of Search ..... 2/16, 20, 21, 160, 2/161.6, 161.1, 161.5, 163

(56) References Cited

U.S. PATENT DOCUMENTS

| | | | | |
|---|---|---|---|---|
| 2,751,598 A | | 6/1956 | Romeo | |
| 3,626,515 A | | 12/1971 | Murray | |
| 3,918,096 A | | 11/1975 | Lim | |
| 4,094,014 A | | 6/1978 | Schroeder | |
| 4,570,269 A | * | 2/1986 | Berlese | 2/16 |
| 4,700,405 A | * | 10/1987 | Sternberg | 2/161.1 |
| 5,058,209 A | | 10/1991 | Eisenberg | |
| 5,758,364 A | * | 6/1998 | Rewoldt | 2/160 |
| 6,341,376 B1 | * | 1/2002 | Smerdon, Jr. | 2/16 |
| 6,367,081 B1 | * | 4/2002 | Harris | 2/16 |
| 6,393,615 B1 | * | 5/2002 | Bedell | 2/161.1 |

FOREIGN PATENT DOCUMENTS

| | | |
|---|---|---|
| DE | 151120 | 5/1904 |
| DE | 8630839.4 | 5/1987 |
| DE | 19702154.9 | 7/1998 |

* cited by examiner

*Primary Examiner*—Katherine Moran
(74) *Attorney, Agent, or Firm*—Katten Muchin Zavis Rosenman

(57) ABSTRACT

The invention relates to a motorcycling glove wherein two or more fingers are connected together with the use of strips of leather or equivalent system.

A rotation of the glove fingers with respect to the hand fingers can be avoided in case of a fall and the seamed joints along the fingers are prevented from breaking.

8 Claims, 4 Drawing Sheets

FIG.1

MOTORCYCLING GLOVE

This is a continuation of Application No. PCT/EP01/02936, filed Mar. 15, 2001.

The invention relates to gloves for motorcyclists in general and in particular those for uses where high speeds are reached, be it on the road or on the racetrack.

These gloves are usually made of leather and their structure differs from that of simple gloves because it is suitably reinforced at various points with rigid or semirigid protections and pads, to protect the hand in the event of falls.

Among the materials suitable for these purposes there are for example carbon fibres, Keviar®, plastic materials in general and others; moreover the seams are also made with special high-strength threads.

Of course, the structure of the glove thus obtained should not be an obstacle to the movements of the motorcyclist during riding.

Consequently there are some parts of the glove that cannot be protected adequately because otherwise the functionality thereof would be thereby greatly compromised: said parts can therefore constitute a weak point for the protection of the hand, in the event of a fall by the motorcyclist.

This applies for example to the fingers of the glove, which must be flexible so as to facilitate the bending movements of the hand present inside it.

For this purpose, according to a frequently used construction, the gloves considered here comprise a lower and an upper layer of leather (or other suitable material), both cut following the profile of the hand, which serve to form respectively the palm and the back of the glove or at least one part of these.

These two layers are then placed on top of each other at a distance corresponding to the thickness of the hand and the fingers of the glove are closed laterally by strips of leather or the like, which are stitched to the aforesaid layers and are commonly referred to as "forks" by persons skilled in the art. Hereinafter, for the sake of brevity, this term will be used to denote said strips.

Of course, the layers of leather used to form the glove can be provided with lining sheaths which will then be on the inside of the glove, once the manufacture thereof has been completed.

A problem that relates to known motorcycling gloves consists in the fact that the stitched joint of the forks in the respective fingers is a weak point in the event of a fall.

In fact in the gloves available nowadays, rigid protections are applied especially on the back of the glove, i.e. on the upper part thereof, in the region of the knuckles of the hand.

It can be understood, however, that it is not possible to apply similar protections or even simply provide pads along the sides of the fingers, because otherwise the flexibility thereof, which is necessary to facilitate the bending of the hand that grips the handle of the accelerator of the motorcycle or acts on the clutch lever, would thereby be impeded in an unacceptable way.

In not particularly serious situations, for example in cases where the fall causes a simple impact of the back of the hand against the road, the structure of gloves known nowadays acts as a kind of protective shield and is stressed only in the region of the protections provided for this purpose.

If, however, during the fall, an abrasion of the glove on the ground occurs, which is moreover a fairly frequent occurrence in the case of motorcycling competitions, said glove tends to rotate around the hand and to assume a deformed shape different from the normal shape in such a way that the weak parts thereof, especially the forks and their joining seams along the fingers of the glove, are also stressed.

The latter often collapse in such conditions and therefore the result is that the fingers of the hand remain exposed outside the glove, with all the risks that can easily be imagined; in this respect one only has to think of the speeds that are reached in certain motorcycling competitions.

From DE 86 30 839 U a glove is also known in which the respective phalanges of one or more fingers are connected with one another strips of flexible material. The said strips are extended transversally so as to connect at least a couple of adjacent fingers of the glove in such a way as to prevent the rotation of the fingers of the glove with respect to the fingers of the corresponding hand. The glove is intended for sanitary applications and does not include any means to protect the hand from impacts in case of severe falls.

From DE-A-197 02 154 another glove is known for protecting the people practicing high speed sports like snow boarding and downhill skiing in case that, as a consequence of the friction forces with the soil, the thumb spreads apart abnormally with respect to the rest of the hand. A noose-shaped band is transversally fastened onto the glove which encircles the thumb and the fingers at the basis thereof (that is in correspondance of the link between the phalanges and the metacarpus of the hand). Not even this glove envisages the adoption of means to protect the hand from impacts in case of severe falls.

The object of the present invention is therefore providing a motorcycling glove with structural and functional characteristics such as to ensure a complete protection of the user hand also in case of severe falls while ensuring at the best the gripping action needed during such a practice.

Said object is achieved by a glove, the characteristic features of which are described in the following claims.

Said characteristic features, together with the effects and advantages arising therefrom, will emerge more clearly from the description of a preferred and non-exclusive embodiment of the invention, which is provided hereinafter with reference to the accompanying drawings in which.

With reference to the above referred drawings, 1 denotes in its entirety an example of a motorcycling glove according to the invention.

Figure 1:
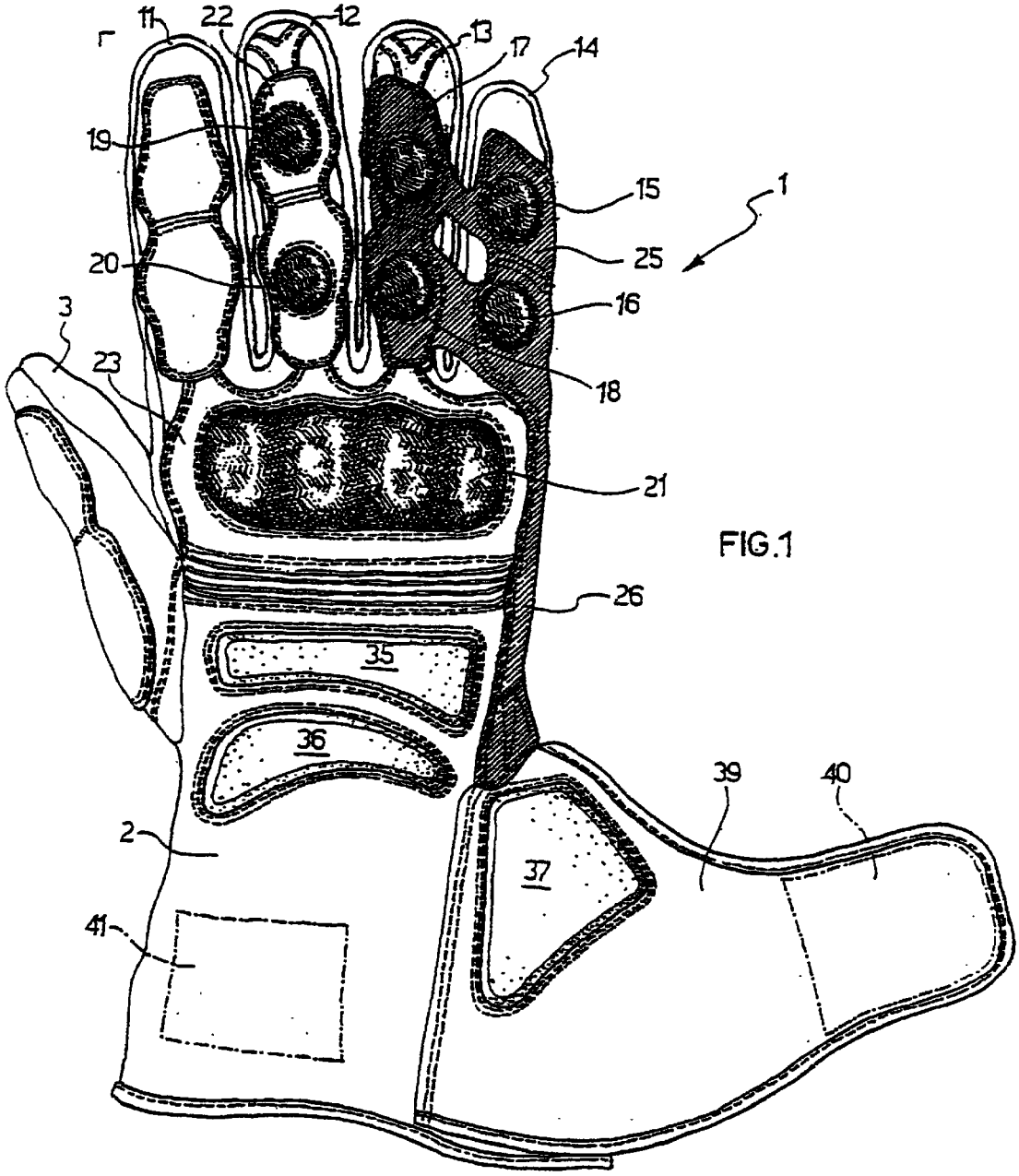
FIG. 1 is a top view of the glove according to the invention.

Said glove has a structure which comprises an upper layer 2 which is preferably made of leather (natural or artificial), but which could however also be made of another suitable material, and shaped at the front following the profile of the index finger, the middle finger, the ring finger and the little finger of a hand (the right hand in the drawing shown in FIG. 1).

For the sake of brevity, these four fingers in the course of the description will also be denoted respectively as I (first), II (second), III (third) and IV (fourth) finger of the glove, while considering the thumb as separate from these.

In the glove 1 the upper layer 2 is associated with a lower layer (not visible in FIG. 1 because this is a top view), which is also shaped following the profile of the hand and to which the thumb 3 is attached: the lower and upper layers are joined together along the respective edges by a seam, while the sides and ends of the four fingers are defined by corresponding forks 11, 12, 13, 14, which are also joined by means of a seam to the upper and lower layers in a manner known per se.

The structure of the glove 1 is also reinforced by a series of rigid protections 15, 16, 17, 18, 19, 20 and 21, each composed of a carbon fibre shell applied in the region of the knuckles of the hand and mounted on a respective shaped piece of leather, stitched onto the upper layer 2.

Figure 2:
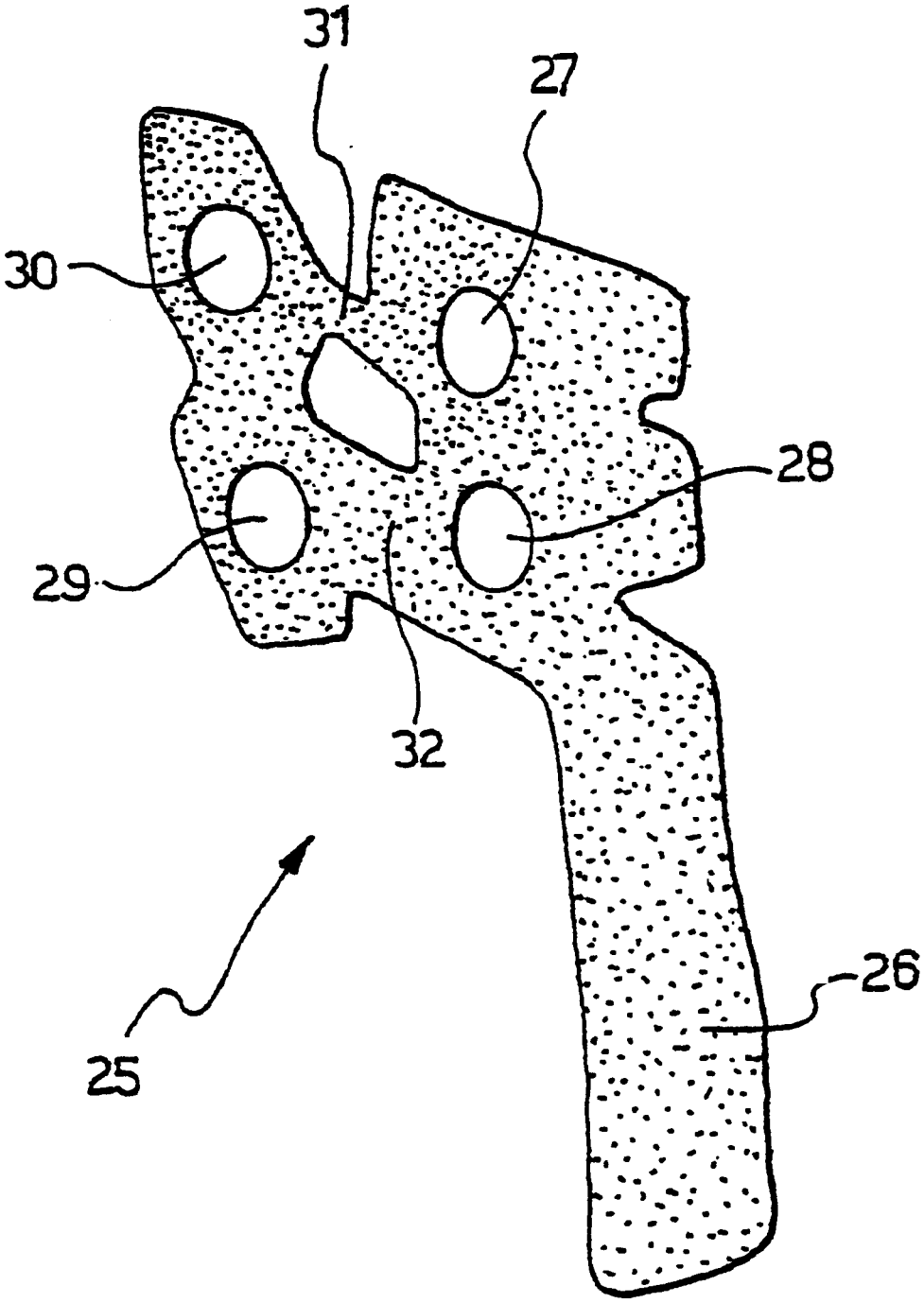
FIG. 2 is a detailed view of a part of the glove shown in FIG. 1.

More specifically, the shell-type protections 19, 20 and 21 are applied by means of shaped strips 22 and 23 (the edge of which is shown in the drawing with dotted lines corresponding to their seams), while the protections 15 to 18 are applied by a bridging element 25 attached to fingers III and IV, which is shown in black in FIG. 1 and visible in detail in FIG. 2 in a flattened condition.

Said bridging element is made of leather or other suitable flexible material and one part thereof is seamed to the fingers of the glove, while an appendix 26 thereof is seamed along the outer side.

As can be seen from the figures, two small oblique strips 31 and 32 extend between the pairs of apertures 27, 28 and 29, 30 of the element 25 in which the shell-type protections 15–18 are inserted; the length of these strips is such as to prevent the third and fourth finger from spreading apart when the bridging element 25 is attached to the glove, without however interfering with the posture of the hand when normally open or in any way with the relative mobility of these fingers.

Furthermore, the oblique positioning of the strips 31, 32, together with the flexibility of the material from which the element 25 is made, allows the bending movements and closing of the fingers of the hand to be assisted, without causing difficulties due to a localised rigidity of the glove.

As can be seen from the drawings, the pair of strips 31, 32 operates at points spaced longitudinally with respect to the fingers of the glove; said strips could, however, be greater than two in number or optionally also be replaced by a single strip of width equal to the spacing of the abovementioned points. Preferably the aforesaid spacing (or the width of the single strip) is substantially equal to the length of one phalanx of the finger in question.

The structure of the glove 1 is then completed by a number of semirigid pads 35, 36, 37, applied in the region of the back and of the wrist of the hand, as well as by a flap 39 for a closure 40, which is folded around the wrist so as to connect two pieces of Velcro® 40, 41, one of which is located on the lower layer of the glove.

From a functional point of view the glove hitherto described allows the prevention of the abovementioned deformations which occur in the event of falls with abrasion of the motorcyclist.

In such an event the bridging element 25, which connects the third and fourth finger together at spaced points, prevents the frictional forces acting on the outer side of the latter and on the side of the glove where the appendix 26 of the element 25 extends (see FIG. 1) from causing the rotation of fingers III and IV respectively around the ring finger and little finger of the motorcyclist's hand.

Said rotations are in fact those which most stress the joints or seams of the forks 13, 14 of fingers III and IV, causing them to break in the conventional gloves.

In this context it should also be observed how the particular embodiment of the element 25 of this example also acts as a reinforcement layer for the outer edge of the glove, i.e. the edge where said element partially enwraps finger IV and extends towards the wrist with the appendix 26.

In more general terms it can be said that the functional core of the invention consists in connecting together several fingers of the glove (i.e. not only fingers III and IV as in the example considered, but also finger II and optionally also finger I) along a portion of their length which is substantially equal to one phalanx or even longer, in such a way as to prevent the rotations of each finger of the glove around the corresponding finger of the hand, owing to the reciprocal joining action which these exert on each other by means of the connecting means.

By virtue of this effect, moreover, the rigid and semirigid protections present on the glove also do not move with respect to the normal operating condition thereof, in such a way as to ensure, in all cases, a protection of the hand during the fall.

The means connecting the fingers of the glove should be such as not to impede the movements of the hand and not impair the functionality of the glove.

They should therefore not be cumbersome and should instead have a flexibility such as to allow in all cases small relative movements between one finger and the other, which are necessary to maintain the functionality required for the purposes of riding the motorcycle.

Consequently it can be understood that, on the basis of these teachings, numerous variants of the invention can be developed with respect to what has been hitherto explained.

Firstly it should be pointed out that it is possible to provide gloves having a bridging element which connects together fingers II, III and IV as well as, optionally, also finger I; for such a purpose it will be sufficient, for example, to modify the piece of leather shown in FIG. 2 with a further shaped portion, to be applied onto finger II of the glove and optionally onto finger I, extending on the opposite side with respect to the location of the appendix 6.

Also in this case one or more small strips can be used to connect this new portion to the rest of the bridging element shown in FIG. 2.

It goes without saying that the bridging element can be made both as a single piece, for example using a sheet of leather cut following the desired profile, and from several parts optionally also made of different materials, joined together by means of seaming, gluing or other systems (for example rivets and the like).

It should be pointed out, moreover, that also the positioning of the bridging element 25 on the upper side of the glove is only one preferred embodiment, because said bridging element could equally be applied on the lower side thereof.

More generally, the positioning of the means for connecting the fingers of the glove according to the invention will depend on the type of solution adopted.

For example, a further variant to what has been described above could consist in joining the fingers together directly, i.e. without strips or other similar connecting elements which act as a bridge, by means of seaming, gluing or other mechanical systems such as rivets or other fasteners; in such a case it should not be excluded that the fingers of the glove may have to be shaped in such a way as to maintain the correct functionality.

It hardly needs to be mentioned that the embodiment shown in the drawings can also be used in combination with the variants considered above: i.e., on one same glove it will be possible, for example, to use a bridging element between fingers III and IV and to glue or seam the first of these to finger II.

It must also be taken into consideration that the means for connecting the fingers of the glove according to the invention may also be of the removable type.

In other words, in the abovementioned example the bridging element 25 is seamed on the glove in such a way as to form an integral part thereof; this allows some advantages to be obtained, but it should nonetheless be pointed out that different connecting means, which can be removed from the glove when required, could be provided.

Figure 3:
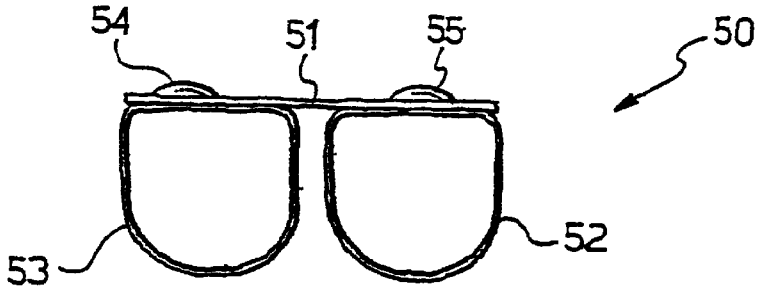
FIGS. 3, 4, 5 and 6 show a variant of the glove according to FIG. 1.
Figure 4:
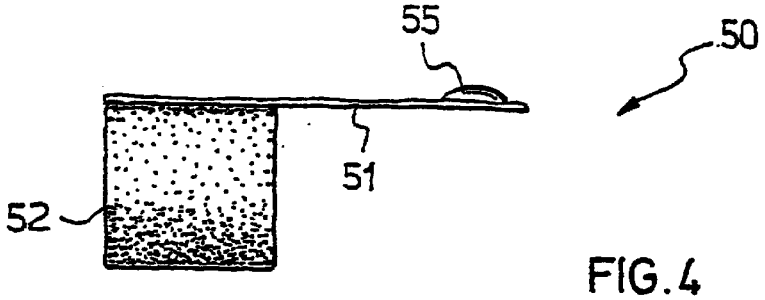
Figure 5:
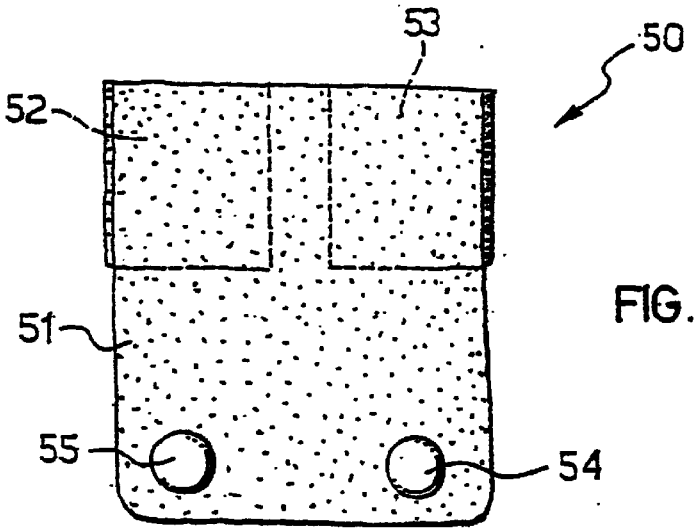
Figure 6:
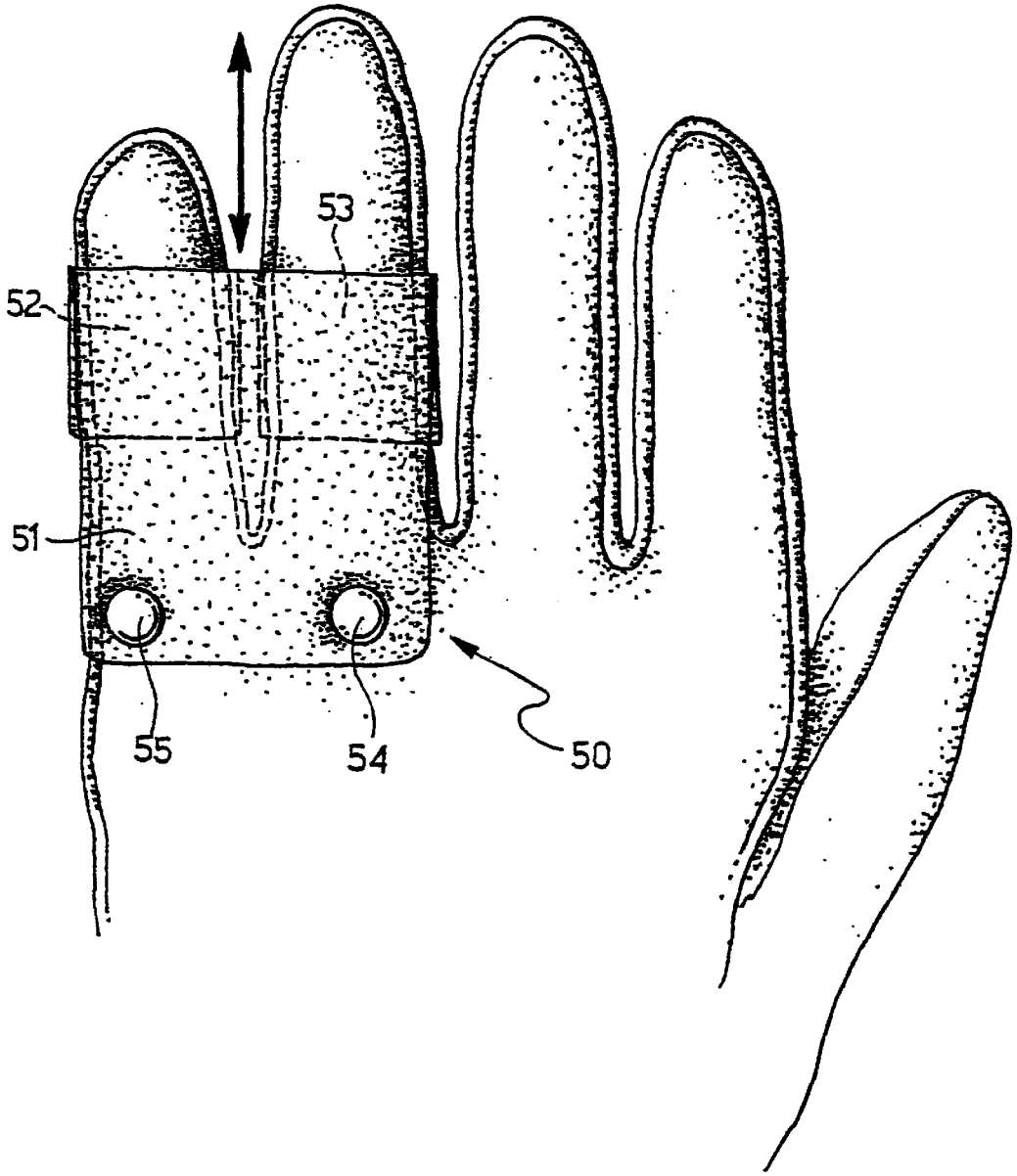

An example of such means is respectively shown from the front, from the side and from above in FIGS. 3, 4 and 5, while FIG. 6 shows in schematic form the application thereof on a glove.

In short, this connecting element 50 comprises a flat portion 51 which is made of flexible material such as leather or the like and on which two open and adjacent fingerstalls 52 and 53, which are also made of flexible material, are applied.

The flat portion 51 is also provided with removable-fastening means, in this case consisting of two press studs 54 and 55; said means could however be any other equivalent system, for example pieces of Velcro®, simple buttons, hook-and-ring or snap fasteners, and the like.

As can be seen from FIG. 6, the connecting element 50 is applied on the glove by inserting each finger in the respective fingerstall 52, 53 and then securing the fastening by means of the press studs 54, 55 (obviously the matching elements of said studs will be provided on the glove).

From what has been described above it can therefore be understood how the functionality of this variant of the invention corresponds to that which has already been explained previously in relation to the example according to FIGS. 1 and 2, to which reference should therefore be made for the sake of brevity.

It should nonetheless be pointed out that in this case the element for connecting the fingers can be slipped off the glove, not being stitched or attached to it in an irreversible manner.

It also hardly needs to be added that there are also possible variants for the element 50 along the lines of those already considered above.

It is therefore possible to provide elements for application only on two but also on three and four fingers of the glove in which the flat portion comprises strips (instead of a single piece) similar to the oblique strips 31, 32 of the first example described.

These and further variants fall within the scope of the following claims.

What is claimed is:

1. Motorcycling glove comprising:

a palm portion, a back portion, thumb finger, index finger, middle finger, ring finger and pinky finger portions, a plurality of finger portions each including a plurality of protrusions extending lengthwise along the length of each finger portion of said plurality, wherein each finger portion of said plurality includes one protrusion located at an upper back finger region and one protrusion located at a lower back finger region, said protrusions adapted to lie over the back knuckle region of a wearer's hand in combination with a removable element made from flexible material overlying and attached to the glove, said element including a plurality of apertures, wherein when the element is attached to the glove, the apertures are positioned to receive the protrusions of the glove, the element is applied to at least two adjacent finger portions along a part of their lengths in order to prevent rotation of the finger portions of the glove with respect to the fingers of the wearer's hand, at least a portion of the element attached at a distant point from the protrusions so as to allow small relative movements between one finger and the other, wherein the element is a bridging element with one or more strips formed as connecting portions between aperture pairs, and an appendix extending along an edge of the glove from the pinky finger towards the wrist, providing the distant attachment point.

2. Motorcycling glove according to claim 1, wherein the appendix is seamed to the glove along an outer edge thereof.

3. Motorcycling glove according to claim 1, wherein the bridging element is leather and is made as a single piece.

4. Motorcycling glove according to claim 1, wherein the bridging element is made from several parts including different materials which are joined together by seaming, gluing or riveting.

5. Motorcycling glove comprising:

a palm portion, a back portion, thumb finger, index finger, middle finger, ring finger and pinky finger portions, a plurality of finger portions each including a plurality of protrusions extending lengthwise along the length of each finger portion of said plurality, wherein each finger portion of said plurality includes one protrusion located at an upper back finger region and one protrusion located at a lower back finger region, said protrusions adapted to lie over the back knuckle region of a wearer's hand in combination with a removable element made from flexible material overlying and attached to the glove, said element including a plurality of apertures, wherein when the element is attached to the glove, the apertures are positioned to receive the protrusions of the glove, the element is applied to at least two adjacent finger portions along a part of their lengths in order to prevent rotation of the finger portions of the glove with respect to the fingers of the wearer's hand, at least a portion of the element attached at a distant point from the protrusions so as to allow small relative movements between one finger and the other, wherein said element includes two adjacent fingerstalls applied to a flat portion at a position distant from removable fastening means for the attachment of the element to the glove.

6. Motorcycling glove according to claim 5, wherein the removable fastening means comprise press studs.

7. Motorcycling glove according to claim 5, wherein the removable fastening means allow for the press-attachment of the removable element to the glove.

8. Motorcycling glove comprising:

a palm portion, a back portion, thumb finger, index finger, middle finger, ring finger and pinky finger portions, each of the middle, ring and pinky finger portions including two protrusions extending lengthwise along the length of each finger portion, wherein each finger portion includes one protrusion located at an upper back finger region and one protrusion located at a lower back finger region, said protrusions adapted to lie over the back knuckle region of a wearer's hand in combination with a removable element made from flexible material overlying and attached to the glove, said element including four apertures, wherein when the element is attached to the glove, the apertures are positioned to receive the protrusions of the glove, the element is applied to at least two adjacent finger portions along a part of their lengths in order to prevent rotation of the finger portions of the glove with respect to the fingers of the wearer's hand, and at least a portion of the element attached at a distant point from the protrusions so as to allow small relative movements between one finger and the other.

* * * * *